US007101014B2

(12) United States Patent
Johnson et al.

(10) Patent No.: US 7,101,014 B2
(45) Date of Patent: Sep. 5, 2006

(54) PRINTER COMPONENT

(75) Inventors: Bruce Johnson, Eagle, ID (US); Tom Skeie, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 10/755,601

(22) Filed: Jan. 12, 2004

(65) Prior Publication Data

US 2005/0151776 A1 Jul. 14, 2005

(51) Int. Cl.
*B41J 29/393* (2006.01)

(52) U.S. Cl. ..... 347/19; 399/12

(58) Field of Classification Search ..... 347/19
See application file for complete search history.

(56) References Cited

U.S. PATENT DOCUMENTS

| | | | | |
|---|---|---|---|---|
| 5,758,224 | A | 5/1998 | Binder et al. | 399/25 |
| 5,930,553 | A * | 7/1999 | Hirst et al. | 399/8 |
| 6,019,449 | A | 2/2000 | Bullock et al. | 347/19 |
| 6,102,508 | A | 8/2000 | Cowger | 347/19 |
| 6,126,265 | A | 10/2000 | Childers et al. | 347/86 |
| 6,154,619 | A | 11/2000 | Boockholdt et al. | 399/24 |
| 6,264,301 | B1 | 7/2001 | Helterline et al. | 347/19 |
| 6,351,621 | B1 * | 2/2002 | Richards et al. | 399/111 |
| 2004/0125165 | A1 * | 7/2004 | Croley et al. | 347/19 |

* cited by examiner

*Primary Examiner*—Stephen Meier
*Assistant Examiner*—Julian D. Huffman

(57) ABSTRACT

A printer component comprises an interface configured for removably electrically coupling to a printer and a memory that stores a unique identifier of the printer through the interface if the interface is electrically coupled to the printer.

16 Claims, 3 Drawing Sheets

24

| 25 | 26 | 27 | 28 |
|---|---|---|---|
| INDEX 1 | PUI 1 | DATE 1 | TIME 1 |
| INDEX 2 | PUI 2 | DATE 2 | TIME 2 |
| INDEX 3 | PUI 3 | DATE 3 | TIME 3 |
| INDEX 4 | PUI 4 | DATE 4 | TIME 4 |
| • | • | • | • |
| • | • | • | • |
| • | • | • | • |
| INDEX N | PUI N | DATE N | TIME N |

29 31 16 30

PRINTER COMPONENT

BACKGROUND

Current printer systems typically include one or more replaceable printer components, such as inkjet cartridges, inkjet printhead assemblies, toner cartridges, ink supplies, etc. Some existing systems provide these replaceable printer components with on-board memory to communicate information to a printer about the replaceable component, such as ink fill level, marketing information, etc. The ink level information can be transmitted to the printer to indicate the amount of ink remaining. A user can observe the ink level information and anticipate the need for replacing a depleted ink container.

Theft of replaceable printer components is a common problem for businesses. One popular method of stealing replaceable printer components occurs when someone swaps an empty printer cartridge for a full one. The person uses the cartridge until it is empty and then swaps the empty one for a full one in a different printer not belonging to them. The rightful owner of the cartridge has no easy way to determine the printer from which the empty cartridge came or the printer in which the stolen full cartridge was installed.

Another common problem occurs when an owner of a cartridge sends the cartridge out to be refilled. The owner of the cartridge has no easy way to confirm that the cartridge, sent out to be refilled, is the same cartridge that is returned to the owner. In addition, if a refilled cartridge is purchased, there is currently no way to determine the history of the cartridge.

SUMMARY

One aspect of the present invention provides a printer component. The printer component comprises an interface configured for removably electrically coupling to a printer and a memory that stores a unique identifier of the printer through the interface if the interface is electrically coupled to the printer.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION

Figures 1, 3:
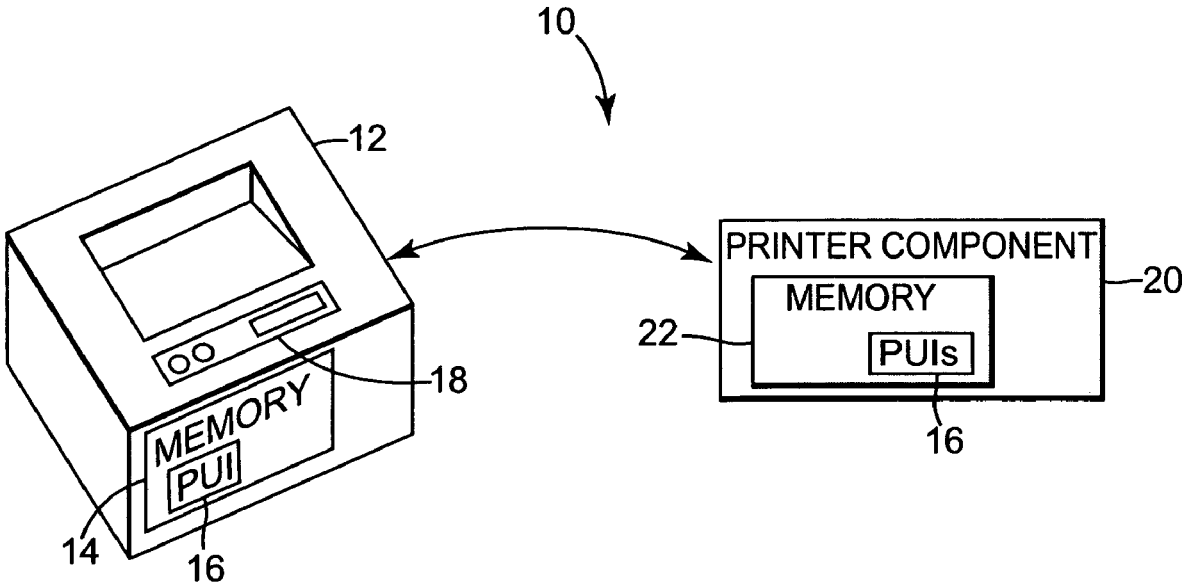
FIG. 1 is a diagram illustrating one embodiment of a printing system.
FIG. 3 is a table illustrating one embodiment of how printer unique identifiers are stored in a memory of a printer component.

FIG. 1 illustrates one embodiment of a printing system 10. Printing system 10 includes a printer 12 and a printer component 20. Printer 12 includes a printer memory 14, for storing a printer unique identifier (PUI) 16, and a user interface 18. Printer component 20 includes a component memory 22. Upon installation of printer component 20 in printer 12, printer 12 senses the presence of printer component 20 and electrically interrogates printer component 20 to determine whether printer component 20 has a component memory 22 in which a PUI 16 can be written. If printer 12 determines that printer component 20 does include a component memory 22 in which a PUI 16 can be written, printer 12 writes its PUI 16 to the component memory 22. In one embodiment, component memory 22 includes a table for storing a log of PUIs, where each PUI in the log identifies a printer in which printer component 20 has been installed.

Printer 12 is any suitable device that can produce an image (such as letters, pictures, drawings, etc.) on or in media (such as paper, plastic, fabric, etc.). Printer 12 may be an impact printer, non-impact printer, such as an inkjet printer or laser printer, digital copier, analog copier, facsimile machine, press machine, silk screen machine, etc. Printer 12 can produce images using one or more of a wide variety of conventional print media (e.g., paper, plastic, fabric, etc.).

Printer component 20 comprises a component of printer 12 that is replaceable, and that can be removably installed in printer 12. In one embodiment, printer component 20 is a consumable, such as an inkjet cartridge, inkjet printhead assembly, printhead and ink supply, toner supply, toner reservoir, or sub-components and combinations of these components.

PUI 16 is an alphanumeric string or other computer readable symbolic representation that uniquely identifies printer 12 and is stored in printer memory 14. In one embodiment, PUI 16 comprises the serial number of printer 12. PUI 16 is electronically written to component memory 22 by printer 12 when printer component 20 is first installed in printer 12. In other embodiments, after installation of printer component 20 in printer 12, PUI 16 is electronically written to component memory 22 by printer 12 when printer component 20 is first used in printer 12, each time printer 12 is turned on, or at set intervals such as daily or weekly. Optionally, the date and/or time at which PUI 16 is electronically written to component memory 22 is electronically written to component memory 22. If printer component 20 is removably installed in another printer (e.g., a second printer) that has a PUI that does not match a PUI stored in component memory 22, then the PUI of the second printer will be electronically written to component memory 22 by the second printer.

In one embodiment, if printer component 20 is removed from the second printer and reinstalled into original printer 12, PUI 16 of printer 12 is electronically written to component memory 22 by printer 12, a second time. This creates a log in component memory 22 of every printer in which printer component 20 has been installed and in what order printer component 20 has been installed in those printers. All PUIs electronically written to component memory 22 by a printer can be retained in component memory 22 throughout the life of printer component 20.

Upon installation of printer component 20 in printer 12, printer 12 senses the presence of printer component 20 and electrically interrogates printer component 20 to determine whether printer component 20 includes a component memory 22 in which PUIs 16 can be stored. If printer component 20 includes a component memory 22 in which PUIs 16 can be stored, printer 12 electronically writes its PUI 16 to component memory 22. Printer component 20 is now electronically traceable to printer 12.

In this arrangement, printer component 20 can be traced from printer to printer. This feature reduces or eliminates removing of printer component 20 from printer 12 for use in an unauthorized printer. If printer component 20 is installed in an unauthorized printer, printer component 20 logs the PUI associated with the unauthorized printer in component memory 22. Therefore, the unauthorized use of printer component 20 is traceable back to the unauthorized printer. In addition, this feature enables users to view the history of printer components, including refilled or reusable printer components.

Figure 2:
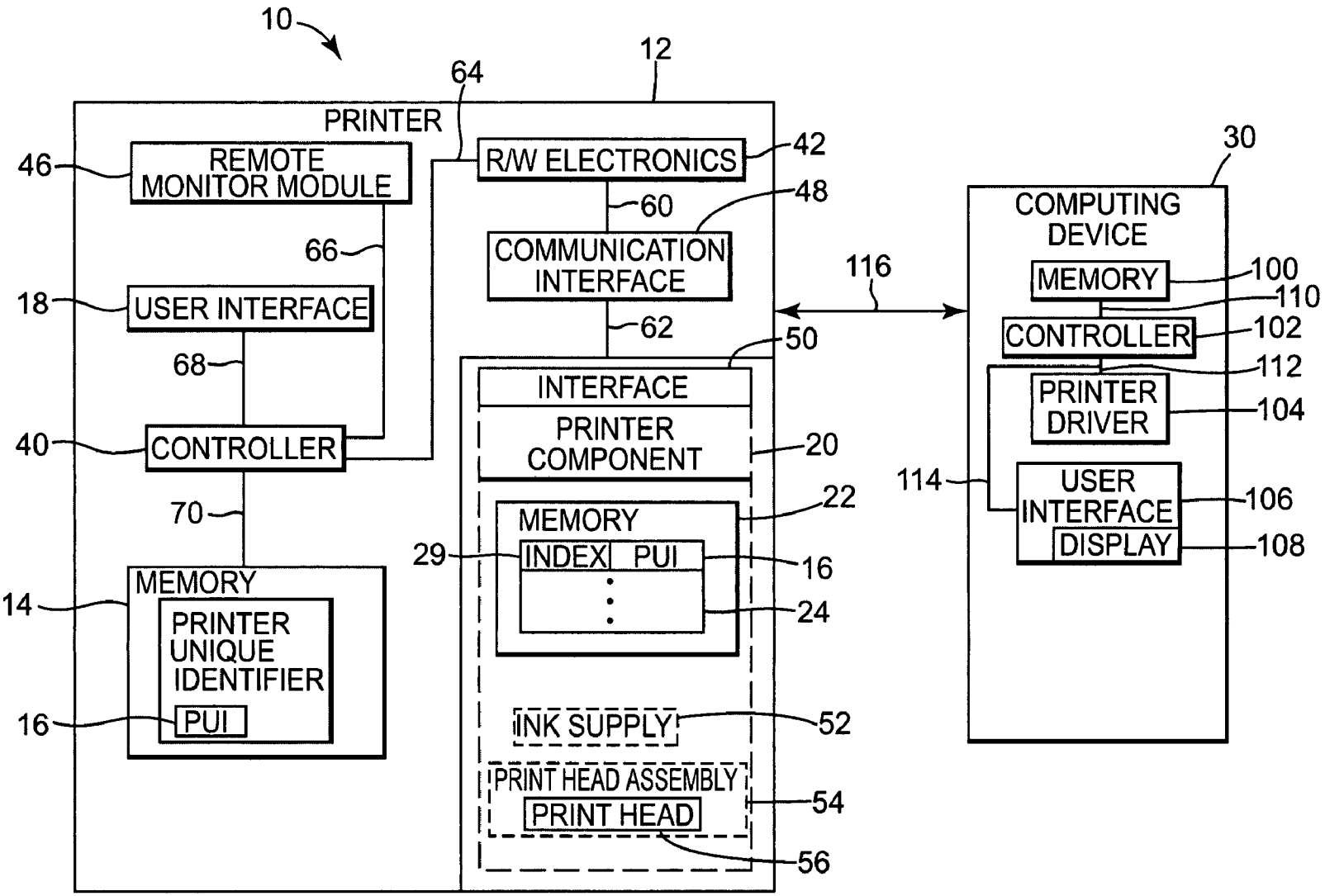
FIG. 2 is a block diagram illustrating one embodiment of a printing system and a computing device.

FIG. 2 is a block diagram illustrating one embodiment of printing system 10 with a computing device 30. Printing system 10 includes a printer 12 including an installed printer component 20. Printer 12 is electrically coupled to computing device 30 through communication link 116. Printer 12 includes a remote monitor module 46, a user interface 18, a controller 40, a printer memory 14, read/write (R/W) electronics 42, and a communication interface 48.

Printer component 20 is a cartridge and includes an interface 50, component memory 22, and optionally includes one or more of an ink supply (or toner supply, toner reservoir) 52, a print head assembly 54, and/or a print head 56. Component memory 22 includes a table 24 for storing PUIs 16 and index values 29 corresponding to the PUIs 16. Printer component 20 is physically installed and removed from printer 12, in a manner known in the art.

Computing device 30 is provided for operating printer 12 and comprises a memory 100, a controller 102, a printer driver 104, and a user interface 106 with a display 108. Controller 102 is electrically coupled to memory 100 through communication link 110, to printer driver 104 through communication link 112, and to user interface 106 through communication link 114.

Controller 40 is electrically coupled to remote monitor module 46 through communication link 66, user interface 18 through communication link 68, printer memory 14 through communication link 70, and read/write electronics 42 through communication link 64. Read/write electronics 42 is electrically coupled to communication interface 48 through communication link 60. Communication interface 48 is electrically coupled to printer component 20 through communication link 62.

Controller 102 includes both electronics and firmware for the control of the various components or sub-assemblies of computing device 30 and of printer 12. Controller 102 communicates with memory 100, printer driver 104, and user interface 106. Controller 102 employs an operating system stored in memory 100. Printer driver 104 cooperates with controller 102 to execute commands and software specific to the operation of printer 12. User interface 106 of computing device 30 permits access to and operation of printer driver 104.

Controller 40 of printer 12 communicates with remote monitor module 46, user interface 18, printer memory 14, and R/W electronics 42 to direct the operation of the components and functions of printer 12, in cooperation with printer driver 104 of computing device 30. Controller 40 performs its operations using an operating system stored in memory 14. User interface 18 is used to access and manage the features of printer 12 (e.g., start, stop, etc.) as well as for reviewing the PUIs 16 stored in component memory 22.

Printer memory 14 comprises computer readable media and includes a combination of volatile or non-volatile memory, such as floppy disks, hard disks, CD-ROMs, flash memory, read-only memory (ROM), and random access memory (RAM). Printer memory 14 stores software related to the operation of printer 12 in addition to the printer's PUI 16.

Read/write electronics 42 comprises circuitry capable of reading and writing to component memory 22 through communication interface 48. Read/write electronics 42 writes PUI 16 into, and reads PUIs 16 from, table 24 of component memory 22.

Communication interface 48 comprises an electrical contact area that establishes electrical communication with a reciprocal electrical contact area of interface 50 to permit communication between R/W electronics 42 and component memory 22. In particular, communication interface 48 and interface 50 comprise electrically conductive elements provided in the forms of electrically conductive contact pins, card-receiving slot, etc. that are suited for removably establishing contact with reciprocating electrically conductive contact elements.

Remote monitor module 46 provides for remote monitoring of printer 12. Remote monitor module 46 permits off-site management and monitoring of printer component 20 to insure that printer component 20 remains installed in the printer to which printer component 20 has been assigned. For example, an administrator can use remote monitor module 46 to periodically confirm that printer component 20 has not been installed in an unauthorized printer. In addition, an administrator can use remote monitor module 46 to periodically confirm that the printer component that is installed in the printer has been assigned to that printer. Remote monitor module 46 is implemented through dedicated control languages, such as Printer Job Language (PJL) and/or Printer Management Language (PML), or through an embedded web server.

Component memory 22 comprises non-volatile memory, such as electronically erasable programmable read-only memory (EEPROM) or write once read many memory (WORM) or FLASH. Table 24 of component memory 22 can be written to multiple times for logging multiple PUIs 16 to printer component 20 as printer component 20 is removed from one printer and installed in another printer.

Printer component 20 is removably installed in printer 12 and electronically traceable to printer 12 once PUI 16 of printer 12 is electronically written to component memory 22. Upon installation of printer component 20 in printer 12, printer 12 recognizes the presence of printer component 20 through communication interface 48 and electronically determines whether printer component 20 includes a component memory 22 in which PUIs 16 can be stored.

In one embodiment, printer 12 determines whether printer component 20 includes a component memory 22 in which PUIs 16 can be stored by attempting to read table 24 of component memory 22. If printer 12 successfully reads table 24 (table exists), then PUIs 16 can be stored in component memory 22. If printer 12 is not successful in reading table 24 (table does not exist), then PUIs 16 cannot be stored in component memory 22.

If printer 12 determines that printer component 20 includes a component memory 22 in which PUIs 16 can be stored, printer 12 electronically determines whether printer component 20 includes a matching PUI 16 stored in component memory 22. If printer 12 does not find a matching PUI 16 in component memory 22, read/write electronics 42 writes PUI 16 to component memory 22. In one embodiment, if printer component 20 does include a matching PUI 16 stored in component memory 22, read/write electronics 42 writes another PUI 16 entry to table 24 of component memory 22.

For example, when printer component 20 is embodied as an inkjet cartridge, printer component 20 is installed and used with printer 12 until the ink supply of the inkjet cartridge is emptied. After the inkjet cartridge is emptied, the inkjet cartridge is removed and replaced by another inkjet cartridge. The inkjet cartridge can be removed before the ink supply is emptied for placement in another printer. However, since the inkjet cartridge (e.g., printer component 20) stores PUI 16 in its component memory 22, the inkjet cartridge is traceable to another printer (i.e., one different than printer 12). This security feature helps prevent employee theft or migration of office supplies to unwanted locations by tracing the usage of printer component 20. In addition, the history of a refilled inkjet cartridge is readable from component memory 22 of the refilled cartridge.

FIG. 3 illustrates one embodiment for storing PUIs 16 in component memory 22. The PUIs 16 are stored in the form of table 24. Table 24 includes an Index column 25, a PUI column 26, a Date column 27, and a Time column 28. Index column 25 includes a list of optional Index values 29 listed from 1-N. Each optional Index 1-N numbers the list of PUI entries numerically from 1-N in the order printer component 20 was installed in each printer or lists other useful information relating to the PUIs. PUI column 26 includes a list of PUIs 16 listed from 1-N. PUI column 26 comprises a list of PUIs for the printers in which printer component 20 was installed. Date column 27 includes a list of optional Date values 30 listed from 1-N. Each optional Date 1-N lists the date on which a corresponding PUI 16 was electronically written to component memory 22. Time column 28 includes a list of optional Time values 31 listed from 1-N. Each optional Time 1-N lists the time at which a corresponding PUI 16 was electronically written to component memory 22.

An entry in table 24 is created each time printer component 20 is installed in a different printer. A list of Index values 29, PUIs 16, Dates 30, and Times 31 are recorded in table 24. Table 24 starts at entry Index 1 and ends at entry Index N, where N designates the total number of printers in which printer component 20 was installed. PUIs 1-N, corresponding to Index values 1-N, list the PUIs 16 of printers in which printer component 20 was installed. Each optional Date 1-N, corresponding to PUIs 1-N, lists the date on which printer component 20 was installed in each printer. Each optional Time 1-N, corresponding to PUIs 1-N, lists the time at which printer component 20 was installed in each printer.

Figure 4:
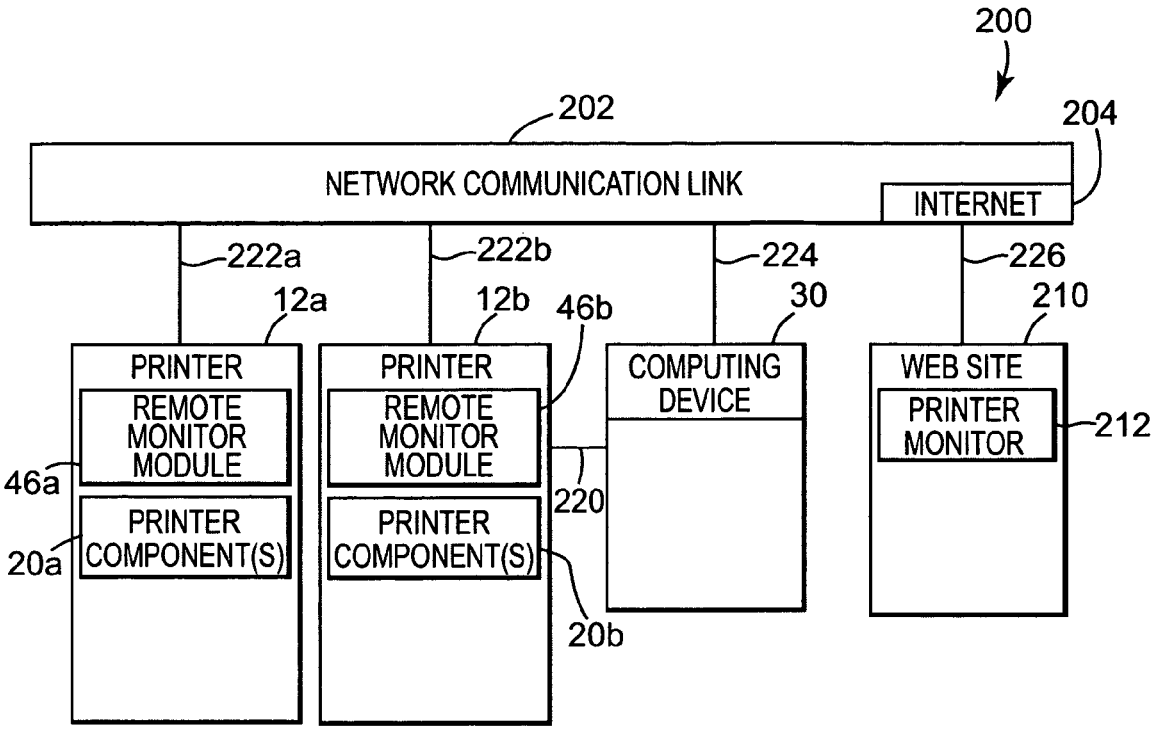
FIG. 4 is block diagram illustrating one embodiment of a printer component monitoring system.

FIG. 4 is a block diagram illustrating one embodiment of a remote printer management system 200. Remote printer management system 200 includes one or more printers 12*a*–12*b*, a computing device 30, a network communication link 202, and a web site 210.

Printers 12*a*–12*b* are electrically coupled to network communication link 202 through communication links 222*a*–222*b*. Computing device 30 is electrically coupled to network communication link 202 through communication link 224 and to printer 12*b* through communication link 220. Web site 210 is electrically coupled to network communication link 202 through communication link 226. Each printer 12*a*–12*b* includes the components of printer 12 illustrated in FIGS. 1 and 2 and previously described, including remote monitor module 46*a*–46*b* and printer component 20*a*–20*b*. Computing device 30 includes the components of computing device 30 illustrated in FIG. 2 and previously described. Web site 210 includes printer monitor 212.

Network communication link 202 comprises an internet communication link (e.g., the Internet), an intranet communication link, or similar high-speed communication link. In one embodiment, network communication link 202 includes an Internet communication link 204. Network communication link 202 permits communication between printers 12*a*–12*b*, computing device 30, and web site 210. However, one or more printers 12*a*–12*b* can be connected directly to computing device 30 through a direct communication link, such as communication link 220.

Web site 210, through printer monitor 212, and/or computing device 30 exerts control over printers 12*a*–12*b* through remote monitor modules 46*a*–46*b* to monitor printer components 20*a*–20*b*. In particular, web site 210 monitors printer components 20*a*–20*b* for determining whether each printer component 20*a*–20*b* has been installed in an unauthorized printer. An administrator can be located remotely to printers 12*a*–12*b* and determine if printer components 20*a*–20*b* are properly located within printers 12*a*–12*b*. An administrator can view table 24 (FIG. 3) in the component memories of printer components 20*a*–20*b* to obtain the histories of printer components 20*a*–20*b*.

Figure 5:
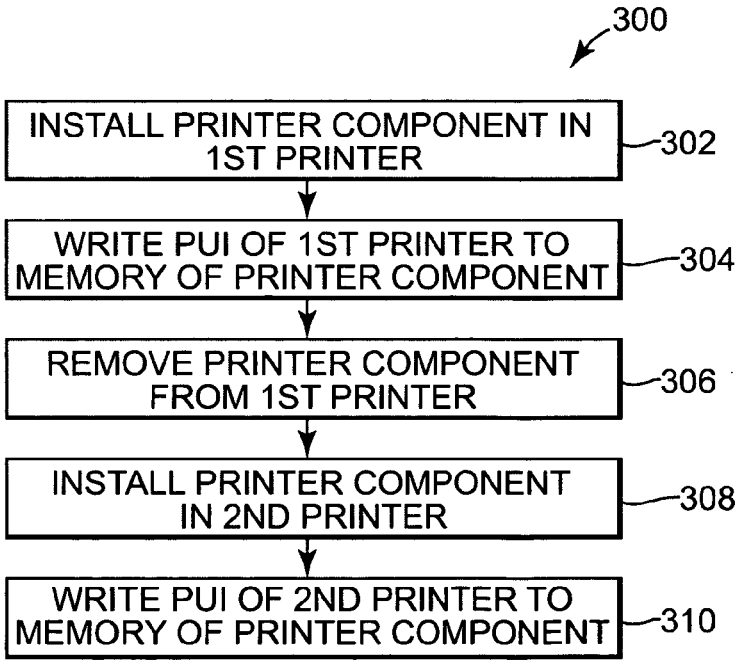
FIG. 5 is a flow diagram illustrating one embodiment of a method for tracking a replaceable printer component.

FIG. 5 is a flow diagram illustrating one embodiment of a method 300 for tracking a printer component 20 (FIG. 2). At 302, printer component 20 is installed in a first printer. At 304, the first printer writes its PUI 16 to table 24 of component memory 22 of printer component 20. Printer component 20 is removed from the first printer at 306. At 308, printer component 20 is installed in a second printer. At 310, the second printer writes its PUI 16 to table 24 of component memory 22 of printer component 20. Printer component 20 is now electronically traceable to both the first and second printers.

In this embodiment, the PUI 16 of the first printer is written to PUI 1 in PUI column 26 (FIG. 3) of table 24 and the PUI 16 of the second printer is written to entry PUI 2 in PUI column 26 of table 24. Entries Index 1 and Index 2 in Index column 25 of table 24 are set to "1" and "2" respectively, or are set to other useful information related to PUI 1 and PUI 2 respectively. Entries Date 1 and Date 2 in date column 27, and entries Time 1 and Time 2 in time column 28 are set to the date and time at which PUI 1 and PUI 2 are written to table 24 respectively.

Embodiments of the present invention are directed to tracking printer components. By storing a unique identifier of each printer in a component memory of a printer component upon installation of the printer component in each printer, the printer component is electronically traceable to all printers in which the printer component was installed. Management of large volumes of printer components is enhanced as printer components can be tracked throughout an office or even out of the office.

What is claimed is:

1. A printing system comprising:

a printer including a printer memory that stores a unique identifier of the printer; and a printer component including a component memory, the printer component configured for removable installation in the printer, wherein the printer is configured to write the unique identifier of the printer to the component memory if the printer component is installed in the printer, and wherein the printer is configured for reading a plurality of unique identifiers from the component memory for determining if the printer component has been installed in an unauthorized printer.

2. The printing system of claim 1, further comprising:

a user interface configured for displaying the unique identifier of the printer.

3. The printing system of claim 1, wherein the component memory comprises a table for storing a list of the plurality of unique identifiers.

4. The printing system of claim 3, wherein the table stores at least one of an index, a date, and a time upon writing of the unique identifier of the printer to the component memory.

5. The printing system of claim 3, further comprising:

a user interface configured for displaying the table.

6. The printing system of claim 1, further comprising:

a controller configured for reading the unique identifier from the printer memory and writing the unique identifier to the component memory.

7. The printing system of claim 6, wherein the controller is further configured for controlling the operation of the printer.

8. The printing system of claim 1, further comprising:

a remote monitor module configured for communicating information about the printer component to a remote device.

9. The printing system of claim 8, wherein the information comprises the unique identifier of the printer.

10. A method of tracking a printer component, the method comprising:

installing a printer component in a first printer;

writing a first unique identifier of the first printer to a memory of the printer component;

removing the printer component from the first printer;

installing the printer component in a second printer;

writing a second unique identifier of the second printer to the memory of the printer component; and determining if the printer component has been installed in an unauthorized printer by checking a plurality of unique identifiers stored in the memory of the printer component to determine if one of the unique identifiers indicates an unauthorized printer.

11. The method of claim 10, further comprising:

providing a user interface for the first printer, and displaying the first unique identifier written to the memory of the printer component through the user interface.

12. The method of claim 11, further comprising:

displaying a history of the printer component through the user interface, the history including the unique identifiers written to the memory during a lifetime of the printer component.

13. The method of claim 12, wherein the user interface is coupled to a network communication link that is coupled to a printer in which the printer component is installed.

14. The method of claim 10, wherein determining if the printer component has been installed in an unauthorized printer comprises performing the determination over a network communication link coupled to a printer in which the printer component is installed.

15. The method of claim 10, further comprising:

writing at least one of a date and a time at which the printer component was installed in the first printer to the memory of the printer component.

16. A printing system comprising:

a printer component including a component memory configured to store a plurality of unique identifiers, with each unique identifier representing a different printer in which the printer component has been installed; and a printer configured to receive the printer component, the printer including:

a printer memory configured to store a unique identifier of the printer;

a controller configured for reading the unique identifier from the printer memory and writing the unique identifier to the component memory, and reading the plurality of unique identifiers from the component memory for determining if the printer component has been installed in an unauthorized printer;

a user interface configured for displaying the unique identifier of the printer and the plurality of unique identifiers from the component memory; and a remote monitor module for communicating information about the printer component to a remote device.

* * * * *

UNITED STATES PATENT AND TRADEMARK OFFICE

CERTIFICATE OF CORRECTION

PATENT NO. : 7,101,014 B2
APPLICATION NO. : 10/755601
DATED : September 5, 2006
INVENTOR(S) : Bruce Johnson et al.

It is certified that error appears in the above-identified patent and that said Letters Patent is hereby corrected as shown below:

In column 7, line 37, in Claim 11, delete "printer," and insert -- printer; --, therefor.

Signed and Sealed this

Eleventh Day of August, 2009

David J. Kappos

David J. Kappos
*Director of the United States Patent and Trademark Office*